US008590629B2

(12) United States Patent
Swietlik et al.

(10) Patent No.: US 8,590,629 B2
(45) Date of Patent: Nov. 26, 2013

(54) FLOW STOP VALVE AND METHOD

(75) Inventors: George Swietlik, Lowestoft (GB); Robert Large, Lowestoft (GB)

(73) Assignee: Pilot Drilling Control Limited, Lowestoft (GB)

( * ) Notice: Subject to any disclaimer, the term of this patent is extended or adjusted under 35 U.S.C. 154(b) by 76 days.

(21) Appl. No.: 12/867,595

(22) PCT Filed: Feb. 16, 2009

(86) PCT No.: PCT/GB2009/000414

§ 371 (c)(1), (2), (4) Date: Oct. 29, 2010

(87) PCT Pub. No.: WO2009/101424

PCT Pub. Date: Aug. 20, 2009

(65) Prior Publication Data

US 2011/0036591 A1 Feb. 17, 2011

(30) Foreign Application Priority Data

Feb. 15, 2008 (GB) ..... 0802856.5

(51) Int. Cl.
*E21B 34/10* (2006.01)
*F16K 31/122* (2006.01)

(52) U.S. Cl.
USPC ..... 166/386; 166/321; 166/325; 166/332.1; 166/373; 137/509

(58) Field of Classification Search
USPC ..... 166/148, 151, 152, 156, 192, 321, 325, 166/327, 373, 381, 383, 386, 332.1, 334.1, 166/162; 137/509
See application file for complete search history.

(56) References Cited

U.S. PATENT DOCUMENTS 1,447,621 A * 3/1923 McDonell et al. ..... 166/162
1,735,718 A * 11/1929 Attendu ..... 239/533.5

(Continued)

FOREIGN PATENT DOCUMENTS

CA 2285767 A1 4/2000
EP 0322170 A2 6/1989

(Continued)

OTHER PUBLICATIONS

PCT/GB2009/000414; International Search Report Published Feb. 11, 2010.

(Continued)

*Primary Examiner* — Giovanna Wright
*Assistant Examiner* — Robert E Fuller
(74) *Attorney, Agent, or Firm* — MH2 Technology Law Group, LLP

(57) ABSTRACT

A flow stop valve positioned in a downhole tubular, particularly a flow stop valve which may be used with a dual density fluid in deep sea drilling or cementing application. The flow stop valve includes a housing and first and second receiving portions attached to first and second ends of the housing. A flow through the valve is selectively permitted between the housing and the first and second receiving portions. A valve element, such as a spindle, is slidably received in the first and second receiving portions. The valve element and housing together form a valve to selectively prevent flow through the flow stop valve. A first end face of the valve element and the first receiving portion define a first chamber and a second end face of the valve element and the second receiving portion define a second chamber.

20 Claims, 9 Drawing Sheets

(56) References Cited

U.S. PATENT DOCUMENTS

| | | | | | |
|---|---|---|---|---|---|
| 2,214,550 | A * | 9/1940 | Edwards | 166/264 |
| 2,644,528 | A * | 7/1953 | Ragan | 166/146 |
| 2,647,015 | A * | 7/1953 | Berlyn | 239/99 |
| 2,647,016 | A * | 7/1953 | Berlyn | 239/99 |
| 2,647,583 | A * | 8/1953 | Kriegel | 166/146 |
| 2,715,943 | A * | 8/1955 | True | 166/63 |
| 2,743,078 | A * | 4/1956 | Jordan | 251/65 |
| 2,757,741 | A * | 8/1956 | O'Reilly | 166/118 |
| 2,796,938 | A * | 6/1957 | Lynes et al. | 166/147 |
| 2,909,227 | A * | 10/1959 | Bostock | 166/325 |
| 3,077,898 | A * | 2/1963 | Raymond | 137/491 |
| 3,090,443 | A | 5/1963 | Bostock | |
| 3,382,928 | A * | 5/1968 | Phillips et al. | 166/145 |
| 3,385,370 | A * | 5/1968 | Knox et al. | 166/317 |
| 3,434,550 | A | 3/1969 | Townsend, Jr. | |
| 3,498,674 | A | 3/1970 | Matthews | |
| 3,554,281 | A | 1/1971 | Ecuer | |
| 3,599,713 | A | 8/1971 | Jenkins | |
| 3,601,190 | A * | 8/1971 | Mott | 166/87.1 |
| 3,603,409 | A | 9/1971 | Watkins | |
| 3,675,678 | A * | 7/1972 | Lamping | 137/505.22 |
| 3,698,411 | A | 10/1972 | Garrett | |
| 3,815,673 | A | 6/1974 | Bruce | |
| 3,957,114 | A * | 5/1976 | Streich | 166/285 |
| 3,964,556 | A | 6/1976 | Gearhart | |
| 3,965,980 | A | 6/1976 | Williamson | |
| 3,967,679 | A | 7/1976 | Liljestrand | |
| 3,973,586 | A | 8/1976 | Hill | |
| 3,973,587 | A | 8/1976 | Cochran | |
| 3,987,848 | A | 10/1976 | Canterbury | |
| 4,072,166 | A | 2/1978 | Tiraspolsky et al. | |
| 4,091,881 | A | 5/1978 | Maus | |
| 4,099,583 | A | 7/1978 | Maus | |
| 4,129,184 | A * | 12/1978 | Parker | 166/385 |
| 4,147,221 | A | 4/1979 | Ilfrey | |
| 4,270,569 | A * | 6/1981 | Reay et al. | 137/514.7 |
| 4,291,772 | A | 9/1981 | Beynet | |
| 4,364,407 | A | 12/1982 | Hillard | |
| 4,391,328 | A * | 7/1983 | Aumann | 166/325 |
| 4,393,930 | A | 7/1983 | Ross et al. | |
| 4,624,316 | A * | 11/1986 | Baldridge et al. | 166/325 |
| 4,625,755 | A * | 12/1986 | Reddoch | 137/327 |
| 4,658,905 | A | 4/1987 | Burge | |
| 4,813,495 | A | 3/1989 | Leach | |
| 4,895,214 | A | 1/1990 | Schoeffler | |
| 4,997,042 | A | 3/1991 | Jordan | |
| 5,092,406 | A * | 3/1992 | McStravick | 166/321 |
| 5,123,436 | A | 6/1992 | Koechlein et al. | |
| 5,174,392 | A * | 12/1992 | Reinhardt | 175/107 |
| 5,191,939 | A | 3/1993 | Stokley | |
| 5,310,012 | A | 5/1994 | Cendre | |
| 5,479,988 | A | 1/1996 | Appleton | |
| 5,584,343 | A | 12/1996 | Coone | |
| 5,682,952 | A | 11/1997 | Stokley | |
| 5,918,673 | A | 7/1999 | Hawkins | |
| 5,924,490 | A * | 7/1999 | Stone | 166/312 |
| 5,971,079 | A | 10/1999 | Mullins | |
| 5,979,572 | A | 11/1999 | Boyd | |
| 6,125,930 | A | 10/2000 | Moyes | |
| 6,216,799 | B1 * | 4/2001 | Gonzalez | 175/5 |
| 6,263,981 | B1 * | 7/2001 | Gonzalez | 175/5 |
| 6,276,455 | B1 * | 8/2001 | Gonzalez | 166/357 |
| 6,325,159 | B1 | 12/2001 | Peterman | |
| 6,328,103 | B1 * | 12/2001 | Pahmiyer et al. | 166/250.17 |
| 6,328,109 | B1 | 12/2001 | Pringle | |
| 6,386,289 | B1 | 5/2002 | Patel | |
| 6,390,190 | B2 | 5/2002 | Mullins | |
| 6,401,823 | B1 * | 6/2002 | Gonzalez et al. | 166/319 |
| 6,415,862 | B1 | 7/2002 | Mullins | |
| 6,435,282 | B1 * | 8/2002 | Robison et al. | 166/386 |
| 6,488,092 | B1 * | 12/2002 | Schoeffler | 166/320 |
| 6,536,540 | B2 | 3/2003 | de Boer | |
| 6,540,020 | B1 * | 4/2003 | Falgout, Sr. | 166/250.01 |
| 6,547,007 | B2 * | 4/2003 | Szarka et al. | 166/317 |
| 6,571,876 | B2 | 6/2003 | Szarka | |
| 6,585,051 | B2 * | 7/2003 | Purkis et al. | 166/374 |
| 6,604,578 | B2 | 8/2003 | Mullins | |
| 6,666,273 | B2 | 12/2003 | Laurel | |
| 6,675,889 | B1 | 1/2004 | Mullins | |
| 6,705,404 | B2 * | 3/2004 | Bosley | 166/372 |
| 6,715,542 | B2 | 4/2004 | Mullins | |
| 6,722,425 | B2 | 4/2004 | Mullins | |
| 6,779,599 | B2 | 8/2004 | Mullins | |
| 6,843,331 | B2 | 1/2005 | de Boer | |
| 6,866,104 | B2 | 3/2005 | Stoesz et al. | |
| 6,926,101 | B2 | 8/2005 | de Boer | |
| 6,966,392 | B2 | 11/2005 | de Boer | |
| 7,013,980 | B2 * | 3/2006 | Purkis et al. | 166/386 |
| 7,090,036 | B2 | 8/2006 | de Boer | |
| 7,093,662 | B2 | 8/2006 | de Boer | |
| 7,168,493 | B2 | 1/2007 | Eddison | |
| 7,299,880 | B2 | 11/2007 | Logiudice | |
| 7,373,972 | B2 * | 5/2008 | Ocalan | 166/66.7 |
| 7,575,051 | B2 | 8/2009 | Stoesz et al. | |
| 7,584,801 | B2 | 9/2009 | de Boer | |
| 7,984,763 | B2 | 7/2011 | Carter et al. | |
| 2001/0007284 | A1 | 7/2001 | French | |
| 2001/0045290 | A1 * | 11/2001 | Pringle et al. | 166/386 |
| 2002/0014338 | A1 * | 2/2002 | Purkis et al. | 166/375 |
| 2002/0020558 | A1 * | 2/2002 | Gonzalez et al. | 175/5 |
| 2002/0079104 | A1 | 6/2002 | Garcia | |
| 2003/0098163 | A1 * | 5/2003 | Hebert et al. | 166/381 |
| 2003/0116325 | A1 * | 6/2003 | Cook et al. | 166/382 |
| 2004/0084213 | A1 | 5/2004 | DeBoer | |
| 2004/0129423 | A1 | 7/2004 | Eddison | |
| 2006/0011354 | A1 | 1/2006 | Logiudice | |
| 2006/0070772 | A1 | 4/2006 | deBoer | |
| 2006/0124352 | A1 * | 6/2006 | Krueger et al. | 175/25 |
| 2007/0009737 | A1 | 1/2007 | Konno | |
| 2007/0012442 | A1 | 1/2007 | Hearn | |
| 2007/0084607 | A1 | 4/2007 | Wright | |
| 2007/0246265 | A1 * | 10/2007 | deBoer | 175/318 |
| 2008/0083541 | A1 * | 4/2008 | Butterfield et al. | 166/386 |
| 2008/0302569 | A1 | 12/2008 | deBoer | |
| 2008/0302570 | A1 | 12/2008 | deBoer | |
| 2009/0211814 | A1 | 8/2009 | de Boer | |
| 2009/0229828 | A1 | 9/2009 | Ross | |
| 2010/0044054 | A1 | 2/2010 | de Boer | |

FOREIGN PATENT DOCUMENTS

| | | | |
|---|---|---|---|
| EP | 0449768 | A1 | 10/1991 |
| GB | 2147641 | A | 5/1985 |
| GB | 2236783 | A | 4/1991 |
| GB | 2245623 | A | 1/1992 |
| GB | 2251446 | A | 7/1992 |
| GB | 2273514 | A | 6/1994 |
| GB | 2314106 | A | 12/1997 |
| GB | 2342935 | A | 4/2000 |
| GB | 2377464 | A | 1/2003 |
| GB | 2378970 | A | 2/2003 |
| GB | 2457497 | A | 8/2009 |
| WO | 93/11336 | A1 | 6/1993 |
| WO | 96/30621 | A1 | 10/1996 |
| WO | 99/15758 | A2 | 4/1999 |
| WO | 99/49172 | A1 | 9/1999 |
| WO | 2002/075104 | A1 | 9/2002 |
| WO | 2004/033845 | A2 | 4/2004 |
| WO | 2004/044366 | | 5/2004 |
| WO | 2004/083596 | | 9/2004 |
| WO | 2005/062749 | | 7/2005 |
| WO | 2006/000799 | A2 | 1/2006 |
| WO | 2007124097 | | 11/2007 |
| WO | 2007/139581 | | 12/2007 |

OTHER PUBLICATIONS

Stanislawek, Mikolaj, Analysis of Alternative Well Control Methods for Dual Density Deepwater Drilling, Thesis Statement submitted to Louisiana State University, May 2005, 1-96.

Shelton, John, Experimental Investigation of Drilling Fluid Formulations and Processing Methods for a Riser Dilution Approach to Dual Density Drilling, Thesis Statement Submitted to Louisiana State University, Dec. 2005, 1-110.

(56) References Cited

OTHER PUBLICATIONS

Brainard, R.R., A Process Used in Evaluation of Managed-Pressure Drilling Candidates and Probabilistic Cost-Benefit Analysis, OTC 18375, May 1-4, 2006, 1-13, Houston, Texas.
Kennedy, John, First Dual Gradient Drilling System Set for Field Test, Drilling Contractor, May/Jun. 2001.
Rehm, Bill, et al, Managed Pressure Drilling, 2008, 1-30, Gulf Publishing Company, Houston, Texas.
Smith, K.L., et al, Subsea Mudlift Drilling JIP: Achieving Dual-Gradient Technology, Deepwater Technology, Aug. 1999, 21-28, Gulf Publishing Company, Houston, Texas.
GB0802856.5; UK Search Report under Section 17, date of search May 14, 2008.
GB0802856.5; UK Search Report under Section 17, date of search Jul. 29, 2008.
Non-Final Office Action dated Feb. 28, 2013, U.S. Appl. No. 13/655,322, filed Oct. 18, 2012, pp. 1-41.
Non-Final Office Action dated Jul. 30, 2013, U.S. Appl. No. 13/655,322, dated Oct. 18, 2012, pp. 1-9.
Non-Final Office Action dated Aug. 19, 2013, U.S. Appl. No. 13/858,579, filed Apr. 8, 2013, pp. 1-54.
Athina Nickitas-Etienne (Authorized Officer), International Preliminary Report on Patentability and Written Opinion of the International Searching Authority dated Feb. 21, 2012, PCT Application No. PCT/GB2009/002016, filed Aug. 18, 2009, pp. 1-6.

* cited by examiner

FLOW STOP VALVE AND METHOD

This disclosure relates to a flow stop valve which may be positioned in a downhole tubular, and particularly relates to a flow stop valve for use in dual density drilling fluid systems.

BACKGROUND

When drilling a well bore, it is desirable for the pressure of the drilling fluid in the newly drilled well bore, where there is no casing, to be greater than the local pore pressure of the formation to avoid flow from, or collapse of, the well wall. Similarly, the pressure of the drilling fluid should be less than the fracture pressure of the well to avoid well fracture or excessive loss of drilling fluid into the formation. In conventional onshore (or shallow offshore) drilling applications, the density of the drilling fluid is selected to ensure that the pressure of the drilling fluid is between the local formation pore pressure and the fracture pressure limits over a wide range of depths. (The pressure of the drilling fluid largely comprises the hydrostatic pressure of the well bore fluid with an additional component due to the pumping and resultant flow of the fluid.) However, in deep sea drilling applications the pressure of the formation at the seabed SB is substantially the same as the hydrostatic pressure HP of the sea at the seabed and the subsequent rate of pressure increase with depth d is different from that in the sea, as shown in FIG. 1*a* (in which P represents pressure and FM and FC denote formation pressure and fracture pressure respectively). This change in pressure gradient makes it difficult to ensure that the pressure of the drilling fluid is between the formation and fracture pressures over a range of depths, because a single density SD drilling fluid does not exhibit this same step change in the pressure gradient.

To overcome this difficulty, shorter sections of a well are currently drilled before the well wall is secured with a casing. Once a casing section is in place, the density of the drilling fluid may be altered to better suit the pore pressure of the next formation section to be drilled. This process is continued until the desired depth is reached. However, the depths of successive sections are severely limited by the different pressure gradients, as shown by the single density SD curve in FIG. 1*a*, and the time and cost to drill to a certain depth are significantly increased.

In view of these difficulties, dual density DD drilling fluid systems have been proposed (see US2006/0070772 and WO2004/033845 for example). Typically, in these proposed systems, the density of the drilling fluid returning from the wellbore is adjusted at or near the seabed to approximately match the density of the seawater. This is achieved by pumping to the seabed a second fluid with a different density and mixing this fluid with the drilling fluid returning to the surface. FIG. 1*b* shows an example of such a system in which a first density fluid 1 is pumped down a tubular 6 and through a drilling head 8. The first density fluid 1 and any cuttings from the drilling process then flow between the well wall and the tubular. Once this fluid reaches the seabed, it is mixed with a second density fluid 2, which is pumped from the surface SF via pipe 10. This mixing process results in a third density fluid 3, which flows to the surface within a riser 4, but is also outside the tubular 6. The fluids and any drilling cuttings are then separated at the surface and the first and second density fluids are reformed for use in the process.

In alternative proposed systems, a single mixture is pumped down the tubular and when returning to the surface the mixture is separated into its constituent parts at the seabed. These separate components are then returned to the surface via the riser 4 and pipe 10, where the mixture is reformed for use in the process.

With either of the dual density arrangements, the density of the drilling fluid below the seabed is substantially at the same density as the fluid within the tubular and the density of the first and second density fluids may be selected so that the pressure of the drilling fluid outside the tubular and within the exposed well bore is between the formation and fracture pressures.

Such systems are desirable because they recreate the step change in the hydrostatic pressure gradient so that the pressure gradient of the drilling fluid below the seabed may more closely follow the formation and fracture pressures over a wider range of depths (as shown by the dual density DD curve in FIG. 1*a*). Therefore, with a dual density system, greater depths may be drilled before having to case the exposed well bore or adjust the density of the drilling fluid and significant savings may be made. Furthermore, dual density systems potentially allow deeper depths to be reached and hence greater reserves may be exploited.

However, one problem with the proposed dual density systems is that when the flow of drilling fluid stops, there is an inherent hydrostatic pressure imbalance between the fluid in the tubular and the fluid outside the tubular, because the fluid within the tubular is a single density fluid which has a different hydrostatic head to the dual density fluid outside the tubular. There is therefore a tendency for the denser drilling fluid in the tubular to redress this imbalance by displacing the less dense fluid outside the tubular, in the same manner as a U-tube manometer. The same problem also applies when lowering casing sections into the well bore.

Despite there being a long felt need for dual density drilling, the above-mentioned problem has to-date prevented the successful exploitation of dual density systems and the present disclosure aims to address this issue, and to reduce greatly the cost of dual density drilling.

STATEMENTS OF INVENTION

According to one embodiment of the invention, there is provided a flow stop valve positioned in a downhole tubular, wherein: the flow stop valve is in a closed position when a pressure difference between fluid outside the downhole tubular and inside the downhole tubular immediately above or at the flow stop valve is below a threshold value, thereby preventing flow through the downhole tubular; and the flow stop valve is in an open position when the pressure difference between fluid outside the downhole tubular and inside the downhole tubular immediately above or at the flow stop valve is above a threshold value, thereby permitting flow through the downhole tubular.

The threshold value for the pressure difference between fluid outside the tubular and inside the downhole tubular at the flow stop valve may be variable.

The flow stop valve may comprise: a first biasing element; and a valve; wherein the first biasing element may act on the valve such that the first biasing element may bias the valve towards the closed position; and wherein the pressure difference between fluid outside the downhole tubular and inside the tubular may also act on the valve and may bias the valve towards an open position, such that when the pressure difference exceeds the threshold value the valve may be in the open position and drilling fluid may be permitted to flow through the downhole tubular. The first biasing element may comprise a spring.

The flow stop valve may further comprise a housing, and a hollow tubular section and a sleeve located within the housing, the sleeve may be provided around the hollow tubular section and the sleeve may be located within the housing, the housing may comprise first and second ends and the hollow tubular section may comprise first and second ends, the first end of the hollow tubular section corresponding to the first end of the housing, and the second end of the hollow tubular section corresponding to a second end of the housing.

The hollow tubular section may be slidably engaged within the housing. The sleeve may be slidably engaged about the hollow tubular section.

The hollow tubular section may comprise a port such that the port may be selectively blocked by movement of the hollow tubular section or sleeve, the port may form the valve such that in an open position a flow path may exist from a first end of the housing, through the port and the centre of the tubular section to a second end of the housing.

A third abutment surface may be provided at a first end of the hollow tubular section such that the third abutment surface may limit the travel of the sleeve in the direction toward the first end of the housing. A flange may be provided at the second end of the hollow tubular section. A second abutment surface may be provided at the second end of the housing such that the second abutment surface of the housing may abut the flange of the tubular section limiting the travel of the hollow tubular section in a second direction, the second direction being in a direction towards the second end of the housing.

A first abutment surface may be provided within the housing between the second abutment surface of the housing and the first end of the housing, such that the first abutment surface may abut the flange of the hollow tubular section limiting the travel of the hollow tubular section in a first direction, the first direction being in a direction towards the first end of the housing.

A spacer element of variable dimensions may be provided between the second abutment surface of the housing and the flange of the hollow tubular section, such that the limit on the travel of the hollow tubular section in the second direction may be varied.

A second biasing element may be provided between the second abutment surface of the housing and the flange of the hollow tubular section. The second biasing element may comprise a spring.

The first biasing element may be provided about the hollow tubular section and the first biasing element may be positioned between the first abutment surface of the housing and the sleeve such that it may resist movement of the sleeve in the second direction.

A piston head may be provided at the first end of the hollow tubular section. Fluid pressure at the first end of the housing may act on the piston head and an end of the sleeve facing the first end of the housing. The projected area of the piston head exposed to the fluid at the first end of the housing may be greater than the projected area of the sleeve exposed to the fluid at the first end of the housing.

The sleeve, housing, hollow tubular section and first abutment surface may define a first chamber, such that when the valve is closed, the first chamber may not be in flow communication with the second end of the housing. A passage may be provided through the sleeve, the passage may provide a flow path from the first end of the housing to the first chamber. The projected area of the sleeve facing the fluid in the first end of the housing is greater than the projected area of the sleeve facing the fluid in the first chamber.

A second chamber may be provided between the sleeve and the housing, the chamber may be sealed from flow communication with the first end of the housing and the first chamber. A fourth abutment surface may be provided on an outer surface of the sleeve and a fifth abutment surface may be provided within the housing, such that the fourth and fifth abutment surfaces may define the second chamber and limit the movement of the sleeve in the direction toward the second end of the housing.

A vent may be provided in the housing wall, the vent may provide a flow path between the second chamber and outside the housing of the flow stop valve. The surface of the sleeve defined by the difference between: the projected area of the sleeve facing the fluid in the first end of the housing; and the projected area of the sleeve facing the fluid in the first chamber, may be exposed to the fluid outside the flow stop valve.

A pressure difference between fluid on a first side of the valve and on a second side of the valve may be substantially the same as the pressure difference between fluid outside the downhole tubular and inside the downhole tubular immediately above the flow stop valve.

The flow stop valve may comprise: a third biasing element; and a valve; wherein the third biasing element may act on the valve such that the third biasing element may bias the valve towards the closed position; and wherein the pressure difference between fluid on a first side of the valve and on a second side of the valve may also act on the valve and bias the valve towards an open position, such that when the pressure difference exceeds the threshold value the valve may be in the open position and drilling fluid is permitted to flow through the downhole tubular.

The flow stop valve may further comprise a housing, and a spindle, the spindle may be located within the housing, and may be slidably received in a first receiving portion at a first end of the housing and a second receiving portion at a second end of the housing, the housing may comprise a first abutment surface and the spindle may comprise a second abutment surface, such that the valve may be in a closed position when the second abutment surface of the spindle engages the first abutment surface of the housing.

The spindle may comprise first and second ends, the first end of the spindle corresponding to the first end of the housing, and the second end of the spindle corresponding to a second end of the housing.

The first end of the spindle and the first receiving portion may define a first chamber and the second end of the spindle and the second receiving portion may define a second chamber, the first and second chambers may not be in flow communication with first and second ends of the housing respectively. The third biasing element may comprise a spring provided in the first chamber.

There may be provided a first passage through the spindle from the first end of housing to the second chamber and a second passage through the spindle from the second end of the housing to the first chamber, such that the first chamber may be in flow communication with the second end of the housing and the second chamber may be in flow communication with the first end of the housing.

There may be provided a first passage through the spindle from the first end of housing to the second chamber and a second passage from a hole in a side wall of the housing to the first chamber, such that the first chamber may be in flow communication with fluid outside the downhole tubular and the second chamber may be in flow communication with the first end of the housing.

The projected area of the first end of the spindle facing the fluid in the first chamber may be less than the projected area of the second end of the spindle facing the fluid in the second chamber.

One or more of the spindle, the first receiving portion and the second receiving portion may be manufactured from drillable materials. One or more of the spindle, the first receiving portion and the second receiving portion may be manufactured from a selection of materials including brass and aluminium.

The flow stop valve may be for use in, for example, drilling and cementing and may be used to control the flow of completion fluids in completion operations. The flow stop valve may be for use in offshore deep sea applications. In such applications, the downhole tubular may extend, at least partially, from the surface to a seabed. The downhole tubular may be, at least partially, located within a riser, the riser extending from the seabed to the surface. The threshold value may be greater than or equal to the pressure difference between the fluid outside the tubular and inside the downhole tubular at the seabed. The first end of the housing may be located above the second end of the housing, the first end of the housing may be connected to a drillstring or casing section and the second end of the housing may be connected to another drillstring or casing section or a drilling device.

The fluid in the downhole tubular may be at a first density. A fluid at a second density may be combined at the seabed with fluid returning to the surface, so that the resulting mixture between the riser and downhole tubular may be at a third density.

According to another embodiment, there is provided a method for preventing flow in a downhole tubular, wherein when a difference between the pressure of fluid outside the downhole tubular and the pressure of fluid inside the downhole tubular at a flow stop valve is below a threshold value, the flow stop valve is in a closed position, preventing flow through the downhole tubular, and when a difference between the pressure of fluid outside the downhole tubular and the pressure of fluid inside the downhole tubular at the flow stop valve is above a threshold value, the flow stop valve is in an open position, permitting flow through the downhole tubular.

According to another embodiment, there is provided a method for preventing flow in a downhole tubular, wherein when a difference between the pressure of fluid on a first side of a flow stop valve and the pressure of fluid on a second side of the flow stop valve is below a threshold value, the flow stop valve is in a closed position, preventing flow through the downhole tubular, and when a difference between the pressure of fluid on a first side of the flow stop valve and the pressure of fluid on a second side of the flow stop valve is above a threshold value, the flow stop valve is in an open position, permitting flow through the downhole tubular.

The method may comprise drilling in a dual fluid density system with the flow stop valve disposed in a drill string. The method may comprise cementing in a dual fluid density system with the flow stop valve disposed adjacent to a casing section. The flow stop valve may be provided in a shoe of a casing string.

According to another embodiment, there is provided a method for drilling in a dual fluid density system using a valve, the valve preventing flow in a downhole tubular, wherein when a difference between the pressure of fluid outside the downhole tubular and the pressure of fluid inside the downhole tubular at a flow stop valve is below a threshold value, the flow stop valve is in a closed position, preventing flow through the downhole tubular, and when a difference between the pressure of fluid outside the downhole tubular and the pressure of fluid inside the downhole tubular at the flow stop valve is above a threshold value, the flow stop valve is in an open position, permitting flow through the downhole tubular.

According to a further embodiment, there is provided a method for drilling in a dual fluid density system using a valve, the valve preventing flow in a downhole tubular, wherein when a difference between the pressure of fluid on a first side of a flow stop valve and the pressure of fluid on a second side of the flow stop valve is below a threshold value, the flow stop valve is in a closed position, preventing flow through the downhole tubular, and when a difference between the pressure of fluid on a first side of the flow stop valve and the pressure of fluid on a second side of the flow stop valve is above a threshold value, the flow stop valve is in an open position, permitting flow through the downhole tubular.

BRIEF DESCRIPTION OF THE DRAWINGS

For a better understanding of the present disclosure, and to show more clearly how it may be carried into effect, reference will now be made, by way of example, to the following drawings, in which.

DETAILED DESCRIPTION

Figure 1A:
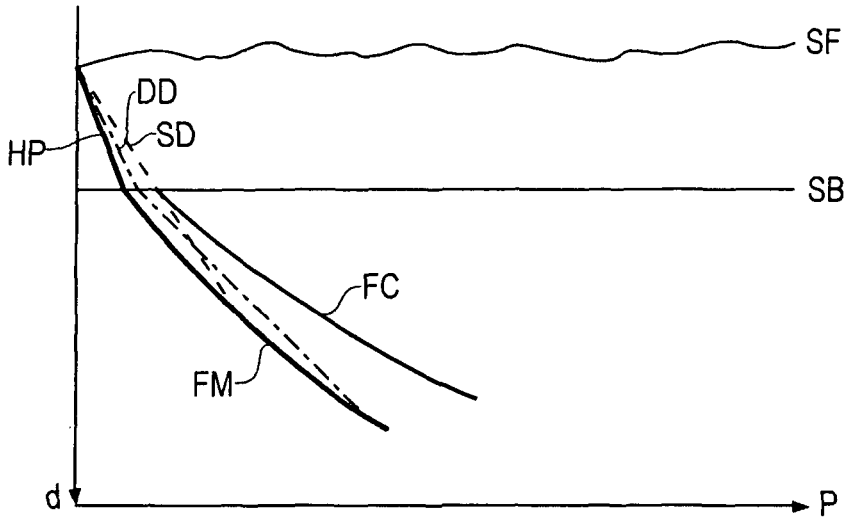
FIG. 1*a* is a graph showing the variation of a formation and fracture pressures beneath the seabed.
Figure 1B:
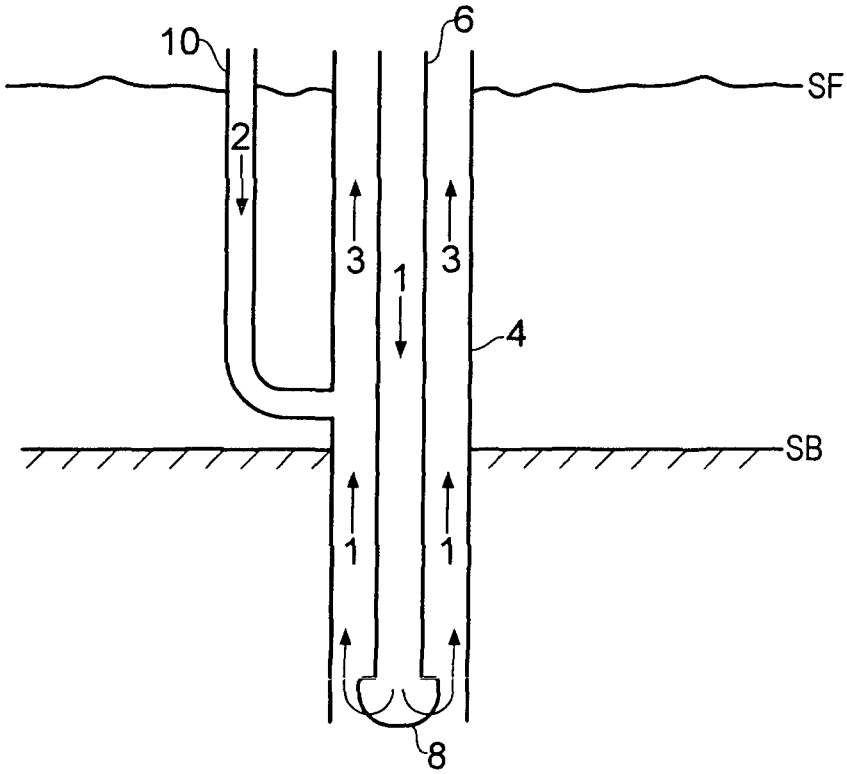
FIG. 1*b* is a schematic diagram showing a proposed arrangement for one embodiment of a dual density drilling system.
Figure 1C:
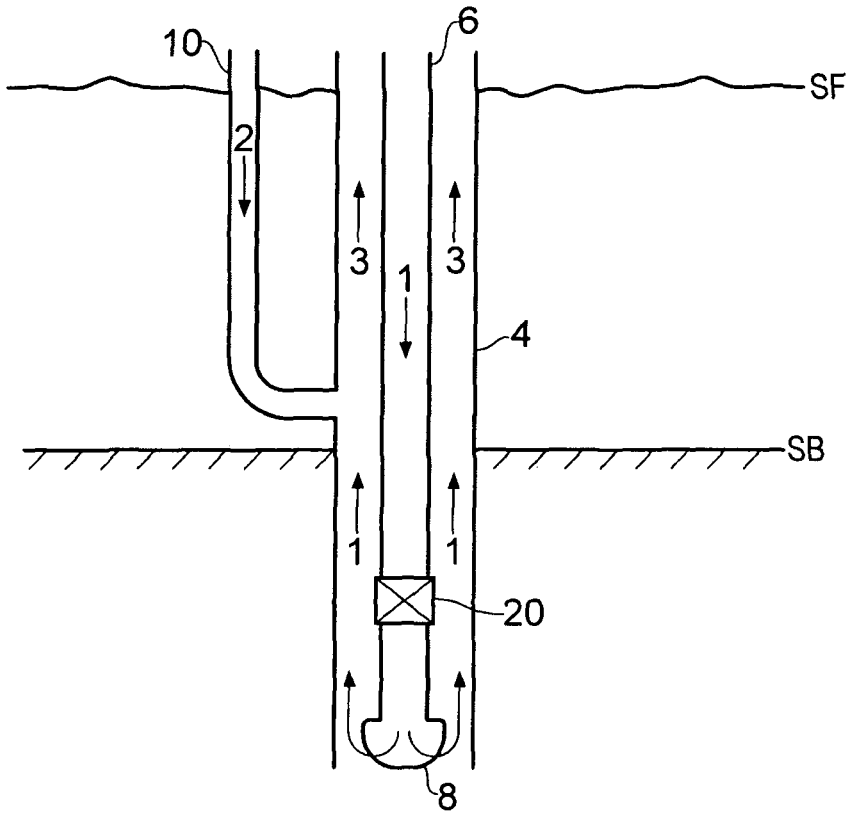
FIG. 1*c* is a schematic diagram showing the positional arrangement of the flow stop valve according to a first embodiment of the disclosure.

With reference to FIG. 1*c*, a flow stop valve 20, according to a first embodiment of the disclosure, is located in a tubular 6 (e.g., a drillstring or casing string) such that, when a drilling head 8 is in position for drilling, the flow stop valve 20 is at any desired point in the tubular, for example, between the seabed SB and the drilling head 8. The illustrated flow stop valve 20 ensures that before the flow of drilling fluid 1 is started, or when it is stopped, the drilling fluid within the tubular 6 is restricted from flow communication with the fluid 1, 3 outside the tubular, thereby preventing uncontrollable flow due to the hydrostatic pressure difference described above.

Figure 2:
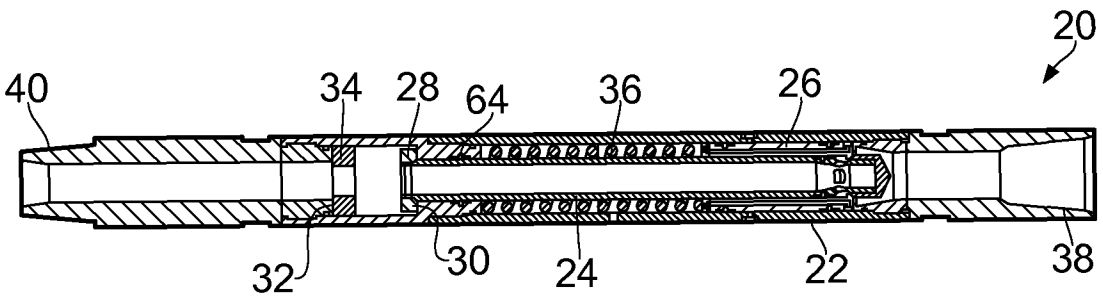
FIG. 2 is a sectional side-view of the flow stop valve according to a first embodiment of the disclosure.

With reference to FIG. 2, the flow stop valve 20, according to the first embodiment of the disclosure, comprises a tubular housing 22 within which there is disposed a hollow tubular section 24. The housing 22 comprises a box 38 at a first end of the housing and a pin 40 at a second end of the housing. (NB, the first end of a component will hereafter refer to the rightmost end as shown in FIGS. 2-4 and accordingly the second end will refer to the leftmost end.) The box 38 and pin 40 allow engagement of the flow stop valve 20 with adjacent sections of a tubular and may comprise conventional box and pin threaded connections, respectively. Although the terms "box" and "pin" are used, any connection to a tubular could be used, for example a socket and plug arrangement. Alternatively, the flow stop valve 20 could be unitary with the tubular 6.

A sleeve 26 is slidably disposed within the housing 22 about a first end of the hollow tubular section 24, such that the sleeve 26 may slide along the hollow tubular section 24 at its first end, and the Sleeve 26 may also slide within the housing 22. A flange 28 is provided at a second end of the hollow tubular section 24 and a first abutment shoulder 30 is provided within the housing 22 between the first and second ends of the hollow tubular section 24 such that the hollow tubular section 24 is slidably engaged within the innermost portion of the first abutment shoulder 30 and the motion of the hollow tubular section 24 in a first direction towards the first end of the housing is limited by the abutment of the flange 28 against the first abutment shoulder 30. (NB, the first direction is hereafter a direction towards the rightmost end shown in FIGS. 2-4 and accordingly the second direction is towards the leftmost end.) A second abutment shoulder 32 is provided within the housing 22 and is placed opposite the first abutment shoulder 30, so that the flange 28 is between the first and second abutment shoulders 30, 32. Furthermore, a variable width spacer element 34 may be placed between the second abutment shoulder 32 and the flange 28 and motion of the hollow tubular section 24 in a second direction towards the second end of the housing may be limited by the abutment of the flange 28 against the spacer element 34 and the abutment of the spacer element 34 against the second abutment shoulder 32. The flange 28 and spacer element 34 may both have central openings so that the flow of fluid is permitted from the centre of the hollow tubular section 24 to the second end of the flow stop valve 20.

The flow stop valve 20, according to the first embodiment of the disclosure, may also be provided with a spring 36, which is located between the first abutment shoulder 30 and the sleeve 26. The illustrated spring 36 may resist motion of the sleeve 26 in the second direction.

Figure 3A:
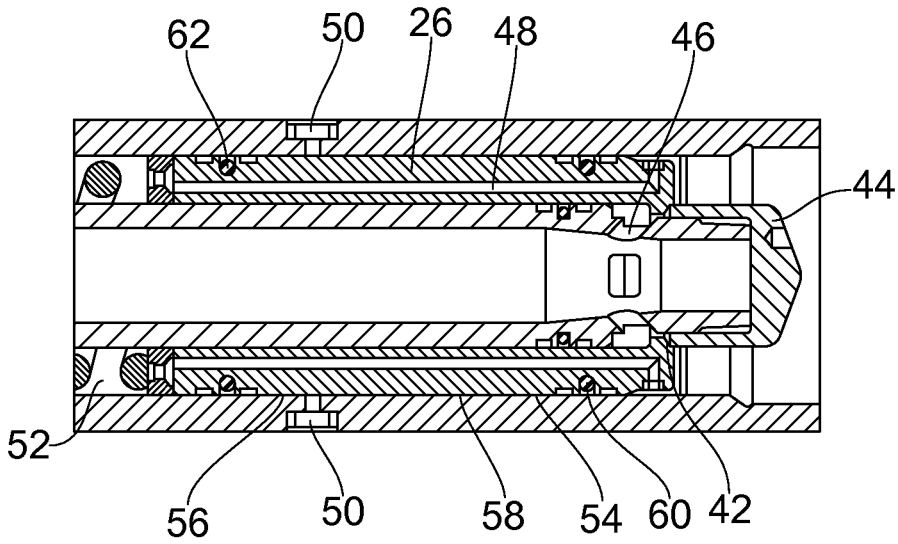
FIGS. 3*a* and 3*b* are sectional side-views showing the valve sleeve according to a first embodiment of the disclosure with FIG. 3*b* being an enlarged view of FIG. 3*a;*
Figure 3B:
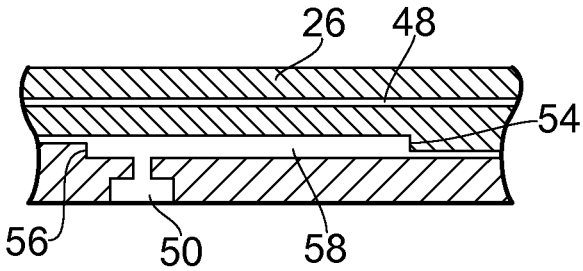

With reference to FIGS. 3*a* and 3*b*, the hollow tubular section 24, according to the first embodiment of the disclosure, further comprises a cone shaped piston head 44 disposed at the first end of the hollow tubular section 24. The piston head 44 may be provided with a third abutment shoulder 42, which abuts a first end of the sleeve 26 thereby limiting motion of the sleeve 26 relative to the hollow tubular section 24 in the first direction. The piston head 44 may be any desired shape. For example, it may be cone shaped as in the illustrated embodiment. The hollow tubular section 24 may further comprise one or more ports 46, which may be provided in a side-wall of the hollow tubular section 24 at the first end of the hollow tubular section 24. The ports 46 may permit flow from the first end of the flow stop valve 20 into the centre of the hollow tubular section 24, through the openings in the flange 28 and spacer element 34 and subsequently to the second end of the flow stop valve 20. However, when the sleeve 26 abuts the third abutment shoulder 42 of the piston head 44, the sleeve 26 may block the ports 46 and hence prevents flow from the first end of the flow stop valve 20 to the centre of the hollow tubular section 24.

The sleeve 26 may further comprise a sleeve vent 48 which provides a flow passage from the first end of the sleeve 26 to the second end of the sleeve 26 and thence to a first chamber 52, which contains the spring 36 and is defined by the housing 22, the hollow tubular section 24, the first abutment shoulder 30 and the second end of the sleeve 26. The sleeve vent 48 may thus ensure that the pressures acting on the first and second ends of the sleeve 26 are equal. However, the projected area of the first end of the sleeve 26 may be greater than the projected area of the second end of the sleeve 26 so that the force due to the pressure acting on the first end of the sleeve 26 is greater than the force due to the pressure acting on the second end of the sleeve 26. This area difference may be achieved by virtue of a fourth abutment shoulder 54 in the sleeve 26 and a corresponding fifth abutment shoulder 56 in the housing 22. The fourth abutment shoulder 54 may be arranged so that the diameter of the sleeve 26 at its first end is greater than that at its second end and furthermore, motion of the sleeve 26 in the second direction may be limited when the fourth and fifth abutment shoulders 54, 56 abut. The fourth and fifth abutment shoulders 54, 56, together with the sleeve 26 and housing 22 may define a second chamber 58 and a housing vent 50 may be provided in the side-wall of the housing 22 so that the second chamber 58 may be in flow communication with the fluid outside the flow stop valve 20. The net force acting on the sleeve 26 is therefore the product of (1) the difference between the pressure outside the flow stop valve 20 and at the first end of the flow stop valve 20, and (2) the area difference between the first and second ends of the sleeve.

Seals 60, 62 may be provided at the first and second ends of the sleeve 26 respectively so that the second chamber 58 may be sealed from the first end of the flow stop valve 20 and the first chamber 52 respectively. Furthermore, seals 64 may be provided on the innermost portion of the first abutment shoulder 30 so that the first chamber 52 may be sealed from the second end of the flow stop valve 20.

Figure 4A:
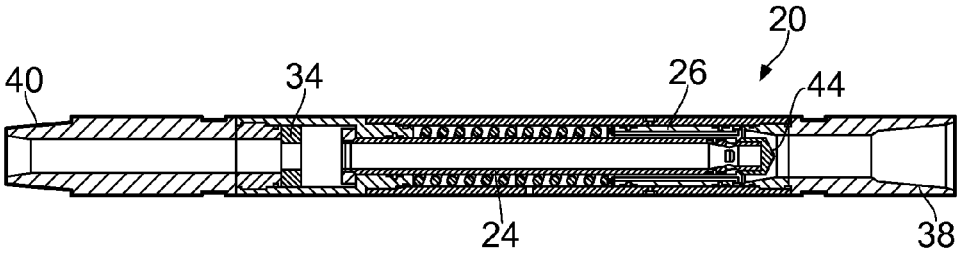
FIGS. 4*a*, 4*b* and 4*c* are sectional side-views of the flow stop valve in the closed, pre-loaded and open positions according to a first embodiment of the disclosure.
Figure 4B:
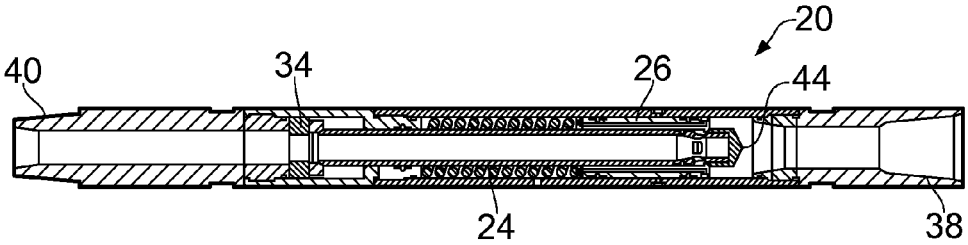
Figure 4C:
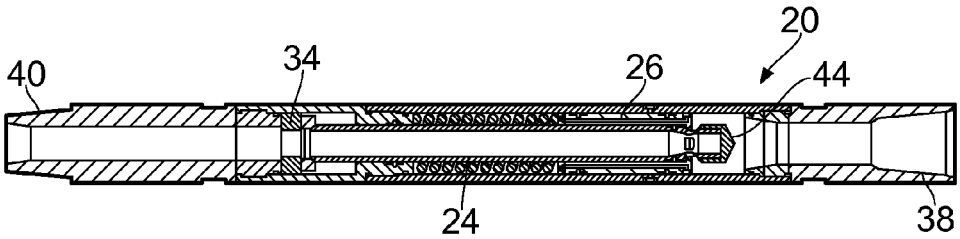

With reference to FIGS. 4*a*, 4*b* and 4*c*, operation of the flow stop valve 20, according to the first embodiment of the disclosure, will now be explained. The flow stop valve 20 may be located in a tubular with the first end above the second end and the flow stop valve 20 may be connected to adjacent tubular sections via the box 38 and pin 40. Prior to lowering of the tubular into the wellbore (e.g., the riser of an offshore drilling rig), there may be a small preload in the spring 36 so that the sleeve 26 abuts the third abutment shoulder 42 of the piston head 44 and the ports 46 are closed, as shown in FIG. 4*a*. In this position no drilling fluid may pass through the flow stop valve 20.

As the tubular and hence flow stop valve 20 is lowered into the riser, the hydrostatic pressures inside and outside the tubular and flow stop valve 20 begin to rise. With one embodiment of a dual density drilling fluid system, the density of the fluid within the tubular may be higher than the density of the fluid outside the tubular, and the hydrostatic pressures within the tubular (and hence those acting on the piston head 44 and first and second ends of the sleeve 26) therefore increase at a greater rate than the pressures outside the tubular. The difference between the pressures inside and outside the tubular may increase until the seabed is reached, beyond which point the fluids inside and outside the tubular may have the same density and the pressures inside and outside the tubular may increase at the same rate.

Before the flow stop valve 20 reaches the seabed, the increasing pressure difference between the inside and outside of the tubular also acts on the hollow tubular section 24 because the top (first) end of the flow stop valve 20 is not in flow communication with the bottom (second) end of the flow stop valve 20. This pressure difference acts on the projected area of the piston head 44, which in one embodiment may have the same outer diameter as the hollow tubular section 24. The same pressure difference may also act on the difference in areas between the first and second ends of the sleeve, however, this area difference may be smaller than the projected area of the piston head 44. Therefore, as the flow stop valve 20 is lowered into the riser, the force acting on the hollow tubular section 24 may be greater than the force acting on the sleeve 26. Once the forces acting on the hollow tubular section 24 and sleeve 26 overcome the small preload in the spring 36, the hollow tubular section 24 may be moved downwards (i.e., in the second direction) and because the force on the piston head 44 may be greater than that on the sleeve 26, the sleeve 26 remains abutted against the third abutment shoulder 42 of the piston head 44. This movement of the hollow tubular section 24 may continue until the flange 28 abuts the spacer element 34, at which point the flow stop valve 20 may be fully preloaded, as shown in FIG. 4*b*. The pressure difference at which this occurs, and the resulting force in the spring, may be varied by changing the thickness of the spacer element 34. With a larger spacer element 34 the hollow tubular section 24 may travel a shorter distance before the flow stop valve 20 is preloaded and may result in a smaller spring force. The opposite applies for a smaller spacer element 34. (The size. of the spacer element 34 may be selected before installing the flow stop valve 20 into the tubular.)

When the hollow tubular section 24 cannot move any further the flow stop valve 20 is in a fully preloaded state. However, in the fully preloaded state, the force acting on the sleeve 26 is not yet sufficient to overcome the spring force, because the pressure difference acting on the sleeve 26 acts on a much smaller area. The sleeve 26 may therefore remain in contact with the third abutment shoulder 42 and the ports 46 may stay closed. The flow stop valve 20 may be lowered further for the pressure difference acting on the sleeve 26 to increase. The spacer element 34 thickness may be selected so that once the flow stop valve 20 reaches the seabed, the pressure difference and hence pressure forces acting on the sleeve 26 at this depth are just less than the spring force in the fully preloaded state. At the seabed the pressure forces are therefore not sufficient to move the sleeve 26, but a further increase, which may be a small increase, in the pressure upstream of the flow stop valve may be sufficient to overcome the spring force in the fully preloaded state and move the sleeve 26. However, as the flow stop valve 20 is lowered below the seabed, the pressure difference may not increase any more (for the reasons explained above) and hence the ports 46 will remain closed. Once the tubular is in place and the flow of drilling fluid is desired, an additional "cracking" pressure may be applied by the drilling fluid pumps, which may be sufficient to overcome the fully preloaded spring force, thereby moving the sleeve 26 downwards (in the second direction) and permitting flow through the ports 46 and the flow stop valve 20.

By preventing flow until the drilling fluid pumps provide the "cracking" pressure, the flow stop valve 20 described above may solve the aforementioned problem of the fluid in the tubular displacing the fluid outside the tubular due to the density differences and resulting hydrostatic pressure imbalances.

In an alternative embodiment, the flange 28 may be replaced with a tightening nut disposed about the second end of the hollow tubular section 24, so that the initial length of the spring 36, and hence the fully preloaded spring force, may be varied at the surface. With such an arrangement, the spacer element 34 may be removed.

Figures 5A, 5B, 5C, 5D, 5E, 5F:
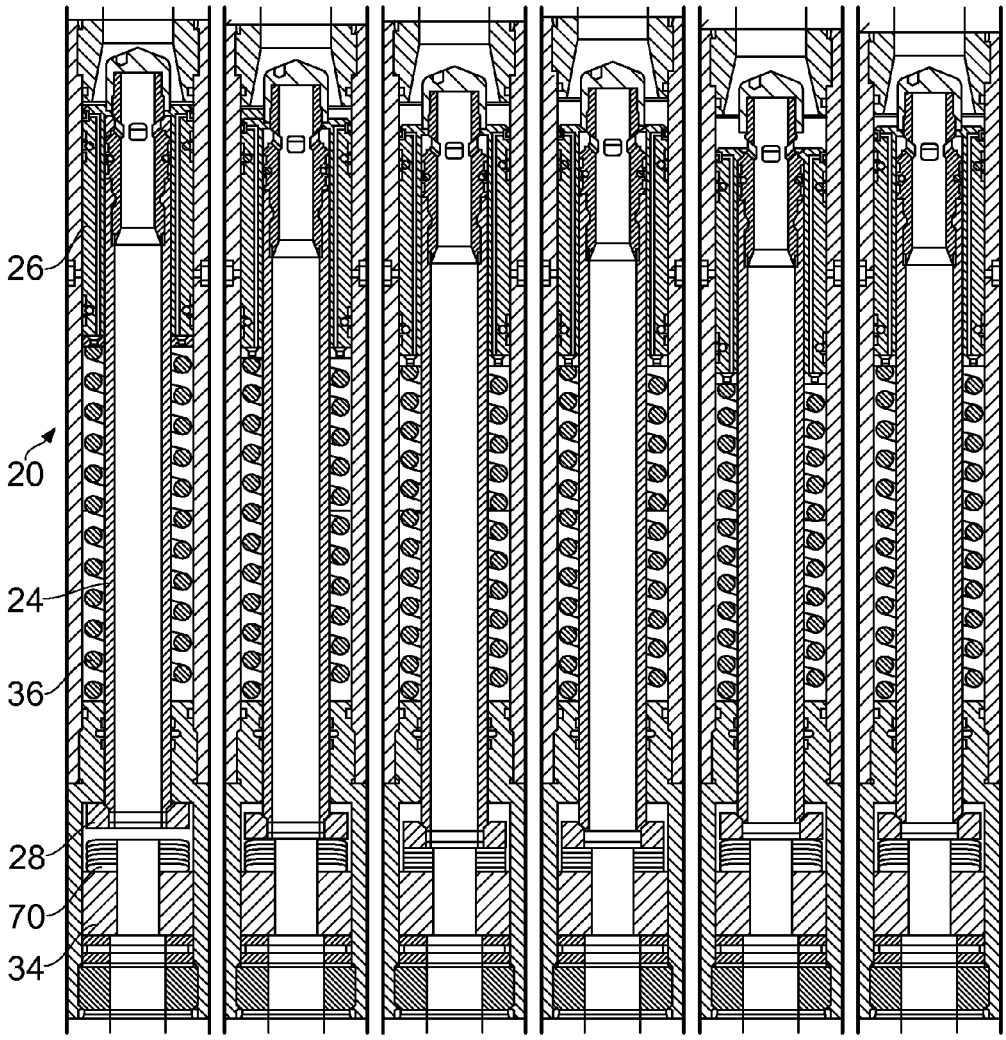
FIGS. 5*a*, 5*b*, 5*c*, 5*d*, 5*e* and 5*f* are sectional side-views of the flow stop valve according to a second embodiment of the disclosure.

With reference to FIGS. 5*a-f*, a flow stop valve 20, according to a second embodiment of the disclosure, may further comprise a second spring 70 disposed between the flange 28 and spacer element 34. The second spring 70 may fit within the housing 22 and the second spring 70 may be sized to allow the passage of fluid through the flow stop valve 20. For example, the inner diameter of the second spring 70 may be greater than, or equal to, the inner diameter of the hollow tubular section 24 and/or the spacer element 34. In an uncompressed state, the second spring 70 may not contact the flange 28 when the hollow tubular section 24 is in its raised position (as shown in FIG. 5*a*). Alternatively, when in an uncompressed state the second spring 70 may at all times contact both the flange 28 and spacer element 34.

Operation of the second embodiment will now be explained with reference to FIGS. 5*a-f*, which show the various stages of the flow stop valve. FIG. 5*a* shows the flow stop valve 20 at the surface prior to lowering into the hole with the sleeve 26 and hollow tubular section 24 in their first-most directions. FIG. 5*b* shows the flow stop valve 20 as it is lowered into the hole and the higher pressure acting at the first end of the flow stop valve 20 causes the spring 36 to compress. When the flow stop valve 20 is lowered further into the hole, for example, as shown in FIG. 5*c*, the pressure differential acting across the sleeve 26 and hollow tubular section 24 increases. The spring 36 may be further compressed by the hollow tubular section 24 being forced in the second direction and, as the flange 28 comes into contact with the second spring 70, the second spring 70 may also be compressed. The pressure differential acting across the sleeve 26 and hollow tubular section 24 reaches a maximum value when the flow stop valve reaches the seabed and as the flow stop valve is lowered further below the sea bed the pressure differential remains substantially constant at this maximum value. This is because the hydrostatic pressure inside and outside the downhole tubular increase at the same rate due to the fluid densities below the sea bed being the same inside and outside the downhole tubular. Therefore, an additional "cracking" pressure is required to open the flow stop valve, and this additional cracking pressure may be provided by a dynamic pressure caused by the flow of fluid in the downhole tubular.

FIG. 5*d* shows the flow stop valve 20 at a depth below the seabed. Once the "cracking" pressure has been applied (for example by pumping fluid down the downhole tubular) the sleeve 26 may begin to move in the second direction and the ports 46 may be opened permitting flow through the flow stop valve 20. As the fluid begins to flow, the pressure difference acting across the hollow tubular section 24 may be reduced. The downward force acting on the hollow tubular section 24 may therefore also be reduced and the second spring 36 may then be able to force the hollow tubular section 24 upwards, i.e. in the first direction, as shown in FIG. 5*e*. Movement of the hollow tubular section 24 in the first direction may also cause the ports 46 to open more quickly. This may serve to further reduce the pressure drop across the flow stop valve 20, which may in turn further raise the hollow tubular section 24.

As shown in FIG. 5*f*, when the dynamic pressure upstream of the flow stop valve is reduced (for example by stopping the pumping of drilling fluid), the sleeve 26 returns to the first end of the hollow tubular section 24 closing the ports 46 and hence the flow stop valve 20.

The second spring 70 may be any form of biasing element and for example may be a coiled spring, disc spring, rubber spring or any other element exhibiting resilient properties. The combined thickness of the spacer element 34 and the second spring 70 in a compressed state may determine the preloading in the spring 36 and hence the "cracking" pressure to open the flow stop valve 20. In one embodiment, to obtain an appropriate cracking pressure for the desired depth, the thickness of the spacer element 34 and/or second spring 70 in a compressed state may be selected before installing the flow stop valve 20 into the tubular.

In an alternative to the second embodiment, a second spring 70 may completely replace the spacer element 34, e.g., so that the second spring 70 may be located between the second abutment shoulder 32 and the flange 28. In such an embodiment the preloading in the spring 36 may be determined by the length of the second spring 70 in a compressed state.

A flow stop valve according to a third embodiment of the disclosure relates to the lowering of a tubular and may in particular relate to the lowering of a casing section into a newly drilled and exposed portion of a well bore. The flow stop valve is located in a tubular being lowered into a well bore, such that, when a tubular is in position for sealing against the well wall, the flow stop valve is at any point in the tubular between the seabed and the bottom of the tubular. In particular, the flow stop valve 120 may be located at the bottom of a casing string, for example, at a casing shoe. The flow stop valve may ensure that before the flow of fluid, e.g., a cement slurry, is started, or when it is stopped, the fluid within the tubular is not in flow communication will the fluid outside the tubular, thereby preventing the flow due to the hydrostatic pressure difference described above. (The aforementioned problem of the hydrostatic pressure imbalance applies equally to cementing operations as the density of a cement slurry may be higher than a drilling fluid.)

Figure 6:
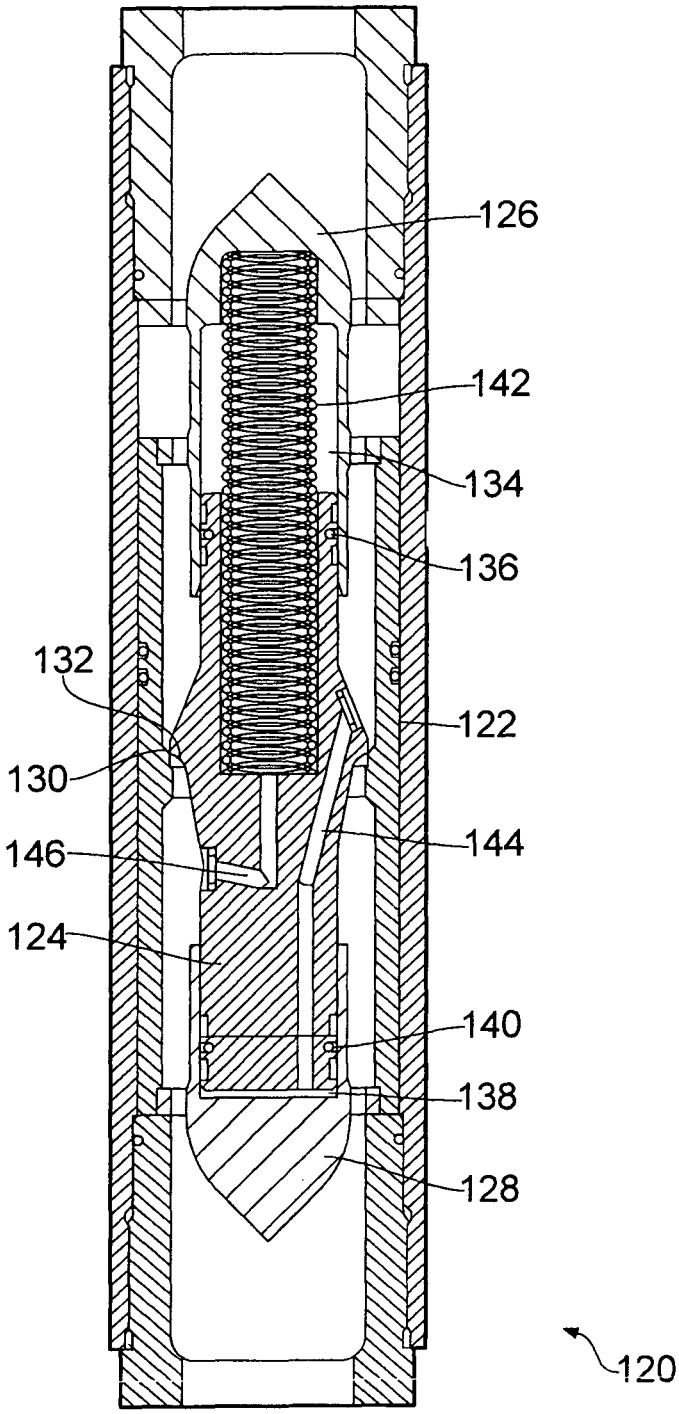
FIG. 6 is a sectional side-view of the flow stop valve according to a third embodiment of the disclosure.

With reference to FIG. 6, the flow stop valve 120, according to the third embodiment of the disclosure, may comprise a housing 122 and a spindle 124. The spindle 124 may be slidably received in both a first receiving portion 126 and a second receiving portion 128. The first receiving portion 126 may be attached to a first end of the housing 122 and the second receiving portion 128 may be attached to a second end of the housing 122. (NB, the first end of a component will hereafter refer to the topmost end as shown in FIG. 6 and accordingly the second end will refer to the bottommost end of the third embodiment) The attachments between the housing 122 and the first and second receiving portions 126, 128 may be arranged such that a flow is permitted between the housing 122 and the first receiving portion 126 and the housing 122 and the second receiving portion 128.

The housing further may comprise a first annular abutment surface 130, which is located on the inner sidewall of the housing and between the first and second receiving portions 126, 128. The spindle 124 may also comprise a second annular abutment surface 132 and the second annular abutment surface may be provided between first and second ends of the spindle 124. The arrangement of the first and second annular abutment surfaces 130, 132 may permit motion of the spindle 124 in a first direction but may limit motion in a second direction. (NB, the first direction is hereafter a direction towards the topmost end shown in FIG. 6 and accordingly the second direction is towards the bottommost end of the third embodiment.) Furthermore, the second annular abutment surface 132 may be shaped for engagement with the first annular abutment surface 130, such that when the first and second annular abutment surfaces abut, flow from first end of the flow stop valve 120 to the second end of the flow stop valve 120 may be prevented.

The first receiving portion 126 and first end of the spindle 124 together may define a first chamber 134. Seals 136 may be provided about the first end of the spindle 124 to ensure that the first chamber 134 is not in flow communication with the first end of the flow stop valve 120. Similarly, the second receiving portion 128 and the second end of the spindle 124 together define a second chamber 138. Seals 140 may be provided about the second end of the spindle 124 to ensure that the second chamber 138 is not in flow communication with the second end of the flow stop valve 120.

The projected area of the first and second ends of the spindle 124 in the first and second chambers 134, 138 may be equal and the projected area of the second annular abutment surface 132 may be less than the projected area of the first and second ends of the spindle 124.

A spring 142 may be provided in the first chamber 134 with a first end of the spring 142 in contact with the first receiving portion 126 and a second end of the spring 142 in contact with the spindle 124. The spring 142 may bias the spindle 124 in the second direction such that the first and second abutment surfaces 130, 132 abut. A spacer element (not shown) may be provided in the first chamber 134 between the spring 142 and spindle 124 or the spring 124 and first receiving portion 126. The spacer element may act to reduce the initial length of the spring 142 and hence the pretension in the spring.

The spindle 124 may also be provided with a first passage 144 and a second passage 146. The first passage 144 may provide a flow path from the first end of the flow stop valve 120 to the second chamber 138, whilst the second passage 146 may provide a flow path from the second end of the slow stop valve 120 to the first chamber 134. However, when the first annular abutment surface 130 abuts the second annular abutment surface 132, the first passage 144 may not be in flow communication with the second passage 146.

The flow stop valve 120 may be manufactured from Aluminium (or any other readily drillable material, for example brass) to allow the flow stop valve 120 to be drilled out once the cementing operation is complete. In addition, the spring 142 may be one or more Belleville washers or a wave spring; e.g., to allow the use of a larger spring section whilst still keeping it drillable. To assist in the drilling operation the flow stop valve 120 may be located eccentrically in an outer casing to allow it to be easily drilled out by a conventional drill bit. Furthermore, the flow stop valve 120 may be shaped to assist the fluid flows as much as possible and so reduce the wear of the flow stop valve 120 through erosion.

In operation the pressure from the first and second ends of the flow stop valve 120 acts on the second and first chambers 138, 134 respectively via the first and second passages 144, 146 respectively. The projected area of the first and second ends of the spindle 124 in the first and second chambers 134, 138 may be equal, but because the pressure in the first end of the flow stop valve 120 is higher than the pressure in the second end of the flow stop valve 120 (for example, when used with the dual density system explained above) the forces acting in the second chamber 138 are higher than those in the first chamber 134. Furthermore, as the projected area of the second annular abutment surface 132 may be less than the projected area of the first and second ends of the spindle 124, the net effect of the pressure forces is to move the spindle 124 in a first direction. However, the spring 142 may act on the spindle 124 to oppose this force and keep the flow stop valve 120 in a closed position (i.e. with the first and second annular abutment surfaces 130, 132 in engagement). The spring 142 does may not support the complete pressure force, because the area in the first and second chambers 134, 138 may be greater than that around the centre of the spindle 124 and the net force acting on the first and second chambers 134, 138 is in the opposite direction to the force acting on the second annular abutment surface 132.

The opening of the flow stop valve 120 may occur when the pressure differential acting over the spindle 124 reaches the desired "cracking" pressure. At this pressure, the net force acting on the spindle 124 is enough to cause the spindle 124 to move in a first direction, thereby allowing cementing fluid to flow. The pressure difference at which this occurs may be varied by selecting an appropriate spacer element to adjust the pretension in the spring.

However, once fluid starts to flow through the flow stop valve 120, the pressure difference acting across the spindle 124 may diminish, although a pressure difference may remain due to pressure losses caused by the flow of fluid through the valve. Therefore, in the absence of the pressure differences present when there is no flow, the spring 142 may act to close the valve. However, as the valve closes the pressure differences may again act on the spindle 124, thereby causing it to re-open. This process may repeat itself and the spindle 124 may "chatter" during use. The oscillation between the open and closed positions assists in maintaining the flow of cementing fluid and these dynamic effects may help to prevent blockage between the first and second annular abutment surfaces 130, 132.

Figure 7:
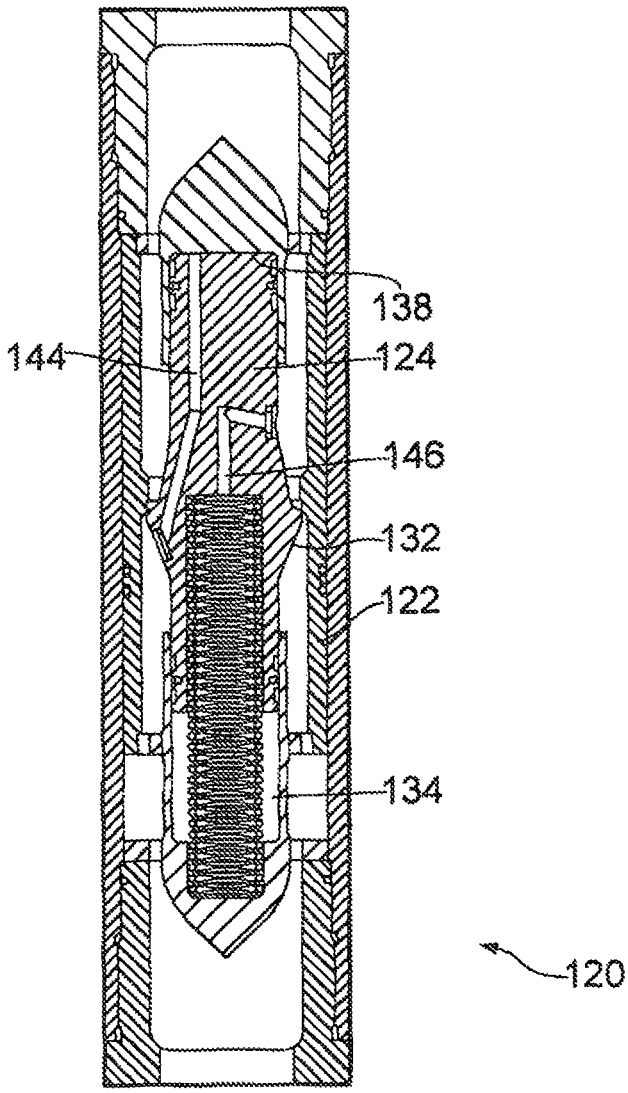
FIG. 7 is a sectional side-view of the flow stop valve according to a fourth embodiment of the disclosure.

With reference to FIG. 7, the flow stop valve 120, according to a fourth embodiment of the disclosure is substantially similar to the third embodiment of the disclosure, except that the flow stop valve 120 may be orientated in the opposite direction (i.e. the first end of the housing 122 is at the bottommost end and the second end of the housing 122 is at the topmost end). In addition, the fourth embodiment may differ from the third embodiment in that the projected area of the second annular abutment surface 132 may be greater than the projected area of the first and second ends of the spindle 124. Aside from these differences the fourth embodiment is otherwise the same as the third embodiment and like parts have the same name and reference numeral.

During operation of the fourth embodiment, higher pressure fluid from above the flow stop valve 120 may act on the first chamber 134 by virtue of the second passage 146, and lower pressure fluid may act on the second chamber 138 by virtue of first passage 144. The pressure forces on the first and second chambers 134, 138, together with the spring force, may act to close the flow stop valve 120 (i.e. with the first and second annular abutment surfaces 130, 132 in engagement). However, as the projected area of the first annular abutment surface 130 may be greater than the projected area of the first and second ends of the spindle 124, the net effect of the pressure forces is to move the spindle 124 into an open position. Therefore, once the pressure forces have reached a particular threshold sufficient to overcome the spring force, the flow stop valve 120 may be open.

In alternative embodiments, the first and second ends of the spindle 124 may have different projected areas. For example, increasing the projected area of the first end of the spindle 124 for the third embodiment relative to the second end of the spindle 124, may further bias the valve into a closed position and may hence increase the "cracking" pressure to open the valve. Other modifications to the projected areas may be made in order to change the bias of the valve, as would be understood by one skilled in the art.

Figure 8:
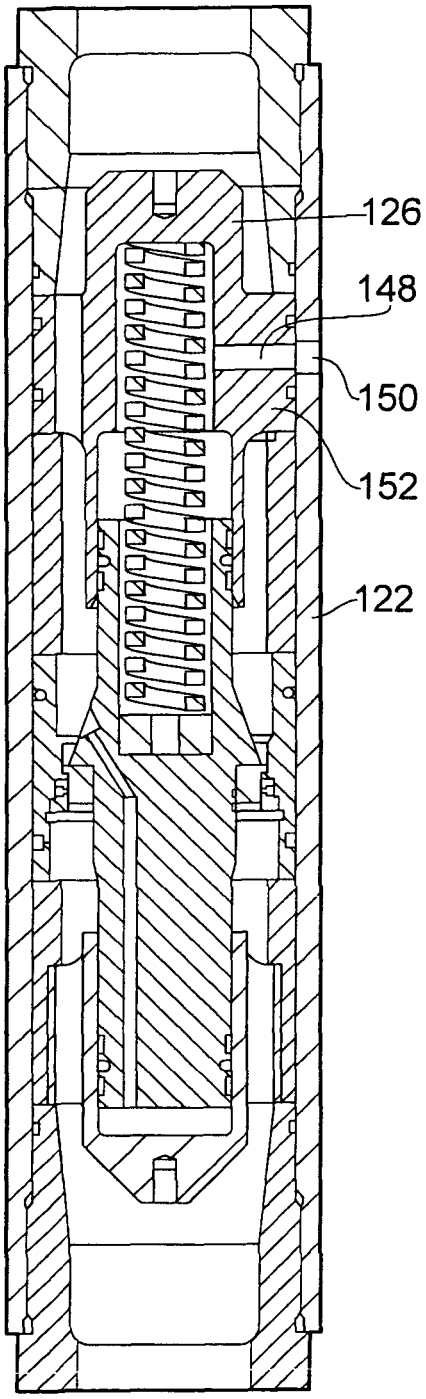
FIG. 8 is a sectional side view of the flow stop valve according to a fifth embodiment of the disclosure.

With reference to FIG. 8, the flow stop valve 120, according to a fifth embodiment of the disclosure is substantially similar to the third embodiment of the disclosure, except that the second passage 146 of the spindle 124 has been omitted. Instead, the first receiving portion 126 may be provided with a third passage 148 which provides a flow passage from the first receiving portion 126 to the outside of the flow stop valve 120. There may be a corresponding hole 150 in the housing 122. The third passage 148 may be provided within a portion 152 of the first receiving portion 120 which extends to meet the inner surface of the housing 122. However, a flow passage may still be maintained around the first receiving portion 126 such that a fluid may flow from the first end of the flow stop valve 120 to the second end of the flow stop valve 120. Aside from these differences, the fifth embodiment is otherwise the same as the third embodiment and like parts have the same name and reference numeral.

The fifth embodiment works in the same way as the third embodiment because the fluid just below the flow stop valve and inside the downhole tubular has the same density as the fluid just below the flow stop valve and outside the downhole tubular (see FIG. 1*b*). Therefore, the hydrostatic pressure of the fluid outside the flow stop valve may be the same as that inside the downhole tubular just below the flow stop valve. (By contrast, the pressure of the fluid above the flow stop valve 120 may be different from that outside the flow stop valve 120 because the density of the fluid above the flow stop valve and inside the downhole tubular is different from the density of the fluid above the flow stop valve and outside the downhole tubular, as shown in FIG. 1*b*.) It therefore follows that, before the flow stop valve 120 opens, the pressure difference between fluid on the first and second sides of the valve may be substantially the same as the pressure difference between fluid inside and outside the valve at a point just above the valve (neglecting the hydrostatic pressure difference between above and below the valve outside of the valve as this may be relatively small in comparison to the depths involved). Thus, the fifth embodiment, which only differs from the third embodiment by tapping the pressure from outside the flow stop valve instead of below the flow stop valve for the first receiving portion 126, may work in the same way as the third embodiment.

While the invention has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

The invention claimed is:

1. A flow stop valve positionable in a downhole tubular, the flow stop valve comprising:

a housing;

a first receiving portion and a second receiving portion attached to first and second ends of the housing respectively by attachments arranged between the housing and the first and second receiving portions, such that a flow through the flow stop valve is permitted in an area defined between the housing and the first receiving portion and in an area defined between the housing and the second receiving portion; and a valve element slidably received in the first and second receiving portions, the valve element and the housing together forming a valve to selectively prevent flow through the flow stop valve:

wherein the flow stop valve is configured such that a pressure difference acts on the valve element such that the flow stop valve is in a closed position when the pressure difference is below a threshold value thereby preventing flow through the downhole tubular, and the flow stop valve is in an open position when the pressure difference is above the threshold value thereby permitting flow through the downhole tubular, wherein the pressure difference comprises one of a difference between a fluid pressure outside of the downhole tubular and a fluid pressure inside of the downhole tubular, and a difference between a fluid pressure at the first end of the housing and a fluid pressure at the second end of the housing, and wherein a first end face of the valve element and the first receiving portion define a first chamber and a second end face of the valve element and the second receiving portion define a second chamber, the first and second chambers being prevented from being in flow communication with first and second ends of the housing respectively when the flow stop valve is in the closed position.

2. The flow stop valve of claim 1, further comprising a biasing element, wherein the biasing element acts on the valve element.

3. The flow stop valve of claim 1, wherein the housing comprises a first abutment surface and the valve element comprises a second abutment surface, such that the valve is in a closed position when the second abutment surface of the valve element engages the first abutment surface of the housing.

4. The flow stop valve of claim 1, further comprising a first passage formed through the valve element from the first end of housing to the second chamber and a second passage through the valve element from the second end of the housing to the first chamber, such that the first chamber is in flow communication with the second end of the housing and the second chamber is in flow communication with the first end of the housing.

5. The flow stop valve of claim 1, further comprising a first passage through the valve element from the first end of housing to the second chamber and a second passage from a hole in a side wall of the housing to the first chamber, such that the first chamber is in flow communication with fluid outside the downhole tubular and the second chamber is in flow communication with the first end of the housing.

6. The flow stop valve of claim 1, wherein a projected area of a first end of the valve element facing the fluid in the first chamber is less than or equal to a projected area of the second end of the valve element facing the fluid in the second chamber.

7. The flow stop valve of claim 1, wherein:

the housing comprises a first abutment surface and the valve element comprises a second abutment surface, such that the valve is in a closed position when the second abutment surface of the valve element engages the first abutment surface of the housing; and a projected area of the second abutment surface is greater than or less than the projected area of the first and second ends of the valve element facing the fluid in the first and the second chambers respectively.

8. The flow stop valve of claim 1, further comprising a biasing element acting on the valve element, wherein the biasing element is provided in the first chamber.

9. The flow stop valve of claim 8, further comprising a spacer element provided in the first chamber to adjust a pretension in the biasing element.

10. The flow stop valve of claim 1, wherein at least one of the valve element, the first receiving portion and the second receiving portion are manufactured from drillable materials.

11. The flow stop valve of claim 1, wherein the flow stop valve is located eccentrically in the downhole tubular.

12. The flow stop valve of claim 1, wherein components of the flow stop valve are shaped to assist fluid flow through the flow stop valve.

13. The flow stop valve of claim 1, wherein the valve element comprises a spindle.

14. The flow stop valve of claim 1, wherein the flow stop valve is adapted to receive cementing fluids.

15. A method for controlling flow in a downhole tubular, the method comprising:

coupling a flow stop valve to the downhole tubular, the flow stop valve comprising:

a housing, a first and a second receiving portion attached to a first and a second end of the housing respectively by attachments arranged between the housing and the first and second receiving portions, wherein a flow through the flow stop valve is permitted in an area defined between the housing and the first receiving portion and in an area defined between the housing and the second receiving portion, and a valve element slidably received in the first and second receiving portions, the valve element and housing forming a valve to selectively prevent the flow through the flow stop valve, wherein a first end face of the valve element and the first receiving portion define a first chamber and a second end face of the valve element and the second receiving portion define a second chamber, the first and second chambers being prevented from being in flow communication with first and second ends of the housing respectively when the flow stop valve is closed; and deploying the flow stop valve such that a pressure difference acts on the valve element, wherein the pressure difference comprises one of a difference between a fluid pressure outside of the downhole tubular and a fluid pressure inside of the downhole tubular, and a difference between a fluid pressure at the first end of the housing and a fluid pressure at the second end of the housing, wherein the flow stop valve closes, restricting flow through the downhole tubular, when the pressure difference is below a threshold value, and wherein the flow stop valve opens, permitting flow through the downhole tubular, when the pressure difference is above the threshold value.

16. The method of claim 15, further comprising drilling in a dual fluid density system, wherein the downhole tubular comprises a drill string.

17. The method of claim 15, further comprising passing cement through the flow stop valve.

18. The method of claim 15, further comprising drilling out at least one of the valve element, the first receiving portion and the second receiving portion.

19. A flow stop valve positionable in a downhole tubular, the flow stop valve comprising:

a housing;

a first receiving portion and a second receiving portion attached to first and second ends of the housing respectively by attachments arranged between the housing and the first and second receiving portions, such that a flow is permitted between the housing and the first receiving portion and between the housing and the second receiving portion;

a valve element slidably received in the first and second receiving portions, the valve element and the housing together forming a valve to selectively prevent flow through the flow stop valve:

wherein the flow stop valve is configured such that a pressure difference acts on the valve element such that the flow stop valve is in a closed position when the pressure difference is below a threshold value thereby preventing flow through the downhole tubular, and the flow stop valve is in an open position when the pressure difference is above the threshold value thereby permitting flow through the downhole tubular, wherein the pressure difference comprises one of a difference between a fluid pressure outside of the downhole fibular and a fluid pressure inside of the downhole fibular, and a difference between a fluid pressure at the first end of the housing and a fluid pressure at the second end of the housing, and wherein a first end of the valve element and the first receiving portion define a first chamber and a second end of the valve element and the second receiving portion define a second chamber, the first and second chambers being prevented from flow communication with first and second ends of the housing respectively when the flow stop valve is in the closed position; and a first passage formed through the valve element from the first end of housing to the second chamber, or a second passage through the valve element from the second end of the housing to the first chamber, or both, such that the second chamber is in flow communication with the first end of the housing, or the first chamber is in flow communication with the second end of the housing, or both.

20. A method for controlling flow in a downhole tubular, the method comprising:

providing a flow stop valve comprising:

a housing, a first and a second receiving portion attached to a first and a second end of the housing respectively by attachments arranged between the housing and the first and second receiving portions, wherein a flow is permitted between the housing and the first receiving portion and between the housing and the second receiving portion, and a valve element slidably received in the first and second receiving portions, the valve element and housing forming a valve to selectively prevent flow through the flow stop valve, wherein a first end of the valve element and the first receiving portion define a first chamber and a second end of the valve element and the second receiving portion define a second chamber, the first and second chambers being prevented from flow communication with first and second ends of the housing respectively when the flow stop valve is closed, and a first passage formed through the valve element from the first end of housing to the second chamber, or a second passage formed through the valve element from the second end of the housing to the first chamber, or both, such that the second chamber is in flow communication with the first end of the housing, or the first chamber is in flow communication with the second end of the housing, or both; and permitting a pressure difference to act on the valve element, wherein the pressure difference comprises a difference between a fluid pressure outside of the downhole tubular and a fluid pressure inside of the downhole tubular, and a difference between a fluid pressure at the first end of the housing and a fluid pressure at the second end of the housing, wherein the flow stop valve closes when the pressure difference is below a threshold value, restricting flow through the downhole tubular, and the flow stop valve opens when the pressure difference is above the threshold value, permitting flow through the downhole tubular.

* * * * *